US007229131B2

(12) United States Patent
Chen

(10) Patent No.: US 7,229,131 B2
(45) Date of Patent: Jun. 12, 2007

(54) INVENTION OF FOLDING CHAIR WITH PORTABLE STEREO SYSTEM

(75) Inventor: Te Lung Chen, Tainan County (TW)

(73) Assignee: Chen, Te-Lung, Tainan (TW)

( * ) Notice: Subject to any disclaimer, the term of this patent is extended or adjusted under 35 U.S.C. 154(b) by 0 days.

(21) Appl. No.: 11/267,911

(22) Filed: Nov. 7, 2005

(65) Prior Publication Data

US 2007/0102974 A1 May 10, 2007

(51) Int. Cl.
*A47C 7/72* (2006.01)

(52) U.S. Cl. ..... 297/217.4; 297/16.2

(58) Field of Classification Search ..... 297/16.2, 297/217.3, 217.4
See application file for complete search history.

(56) References Cited

U.S. PATENT DOCUMENTS 5,482,352 A * 1/1996 Leal et al. ..... 297/217.4
5,624,156 A * 4/1997 Leal et al. ..... 297/217.4
5,838,808 A * 11/1998 Prosser ..... 297/217.1
6,623,072 B1 * 9/2003 Mellace ..... 297/217.4
6,764,133 B2 * 7/2004 Osato ..... 297/217.4
6,932,377 B2 * 8/2005 Bretschger et al. ..... 280/642

* cited by examiner

*Primary Examiner*—Peter R. Brown

(57) ABSTRACT

A folding chair that comes with a portable stereo system. The present invention includes foldable supporting frame (1), chair seat (2), chair back (3), primary armrest (4), secondary armrest (5), mini boom box (6&7), battery channel (8), audio frequency receiver (9), audio frequency wire (10), primary armrest support (11), secondary armrest support (12), chair back support panel (13&14), chair front edge (21), horizontal face (41&51), vertical face (42&52), and a music-player sack (420).

The present invention offers people a whole new perspective view on how a folding chair can be utilized. The idea of the invention delivers the convenience of how seating and entertaining enjoyment can be combined in one device for traveling people in order to reduce traveling difficulties.

2 Claims, 4 Drawing Sheets

INVENTION OF FOLDING CHAIR WITH PORTABLE STEREO SYSTEM

BACKGROUND

Folding chair is a common gear people carry with themselves when they travel. For instance, when they go fishing or go to beach. To reduce carrying difficulty, folding chair's main characteristics is to be foldable and be easy to carrying around.

Moreover, when people travel around, they would want to listen to some music in order to relieve the tension that they face from daily life and from work. But most music playing devices on the market now have one disadvantage is that if they are small in size, then they require earphones to go with the playing devices in order to play out the music. However, this way of playing music is inconvenient and the music that they play out has very rough quality.

Therefore, the present invention fixes this difficulty by combining the music-playing device with a folding chair to create one portable traveling device that people can sit on and to listen to music.

SUMMARY

A folding chair that comes with a portable stereo system. The present invention includes foldable supporting frame (1), chair seat (2), chair back (3), primary armrest (4), secondary armrest (5), mini boom box (6&7), battery channel (8), audio frequency receiver (9), audio frequency wire (10), primary armrest support (11), secondary armrest support (12), chair back support panel (13&14), chair front edge (21), horizontal face (41&51), vertical face (42&52), and a music-player sack (420).

The music-playing device is designed and in stored on the armrest, and it is in the form of two mini boom boxes of which play out music. But the mini boom boxes are not limited to be in stored on the armrest. They can be in stored on any part of the folding chair in which is most convenient. Thus, the present invention employs a whole new different idea of how people can utilize a folding chair than of those conventional folding chairs on the market.

DETAIL DESCRIPTION OF THE INVENTION

Figure 1:
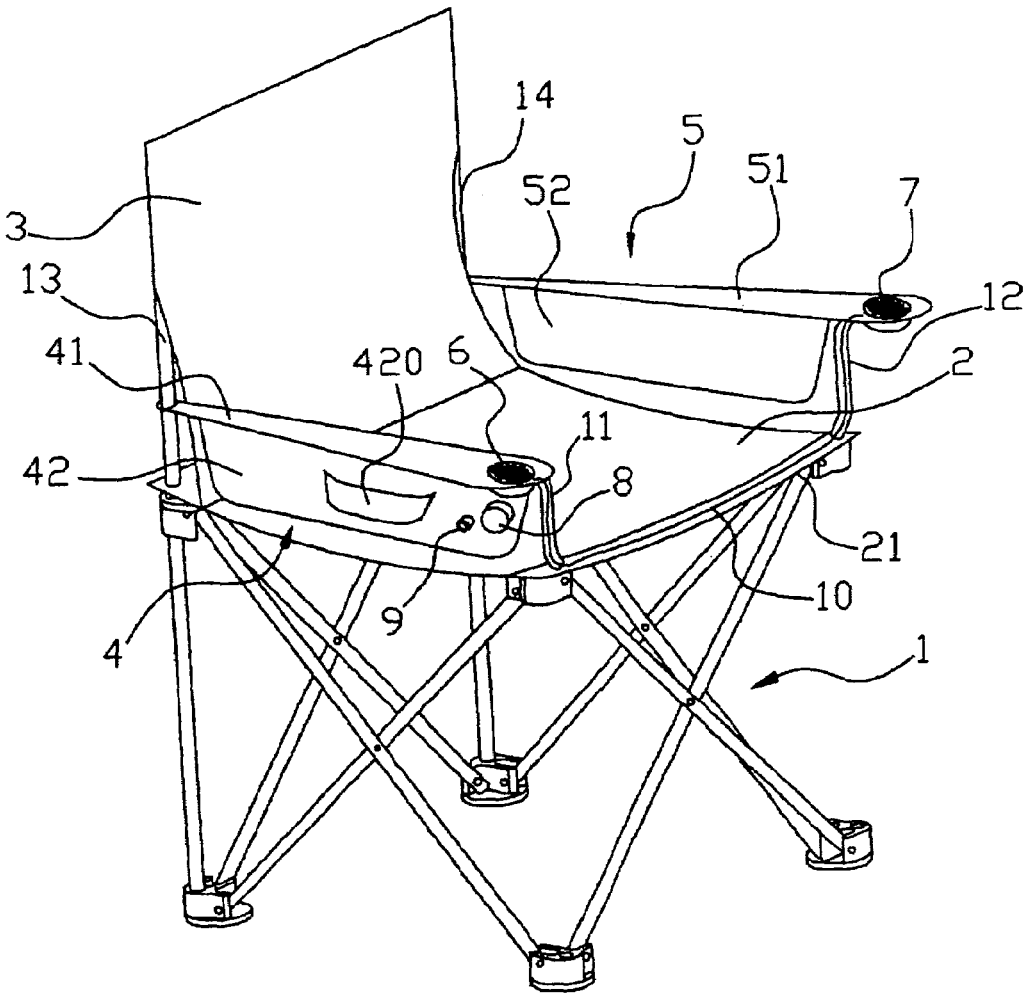
FIG. 1 is the perspective view of the present invention in 3-dimensional drawing. Example one.
Figure 2:
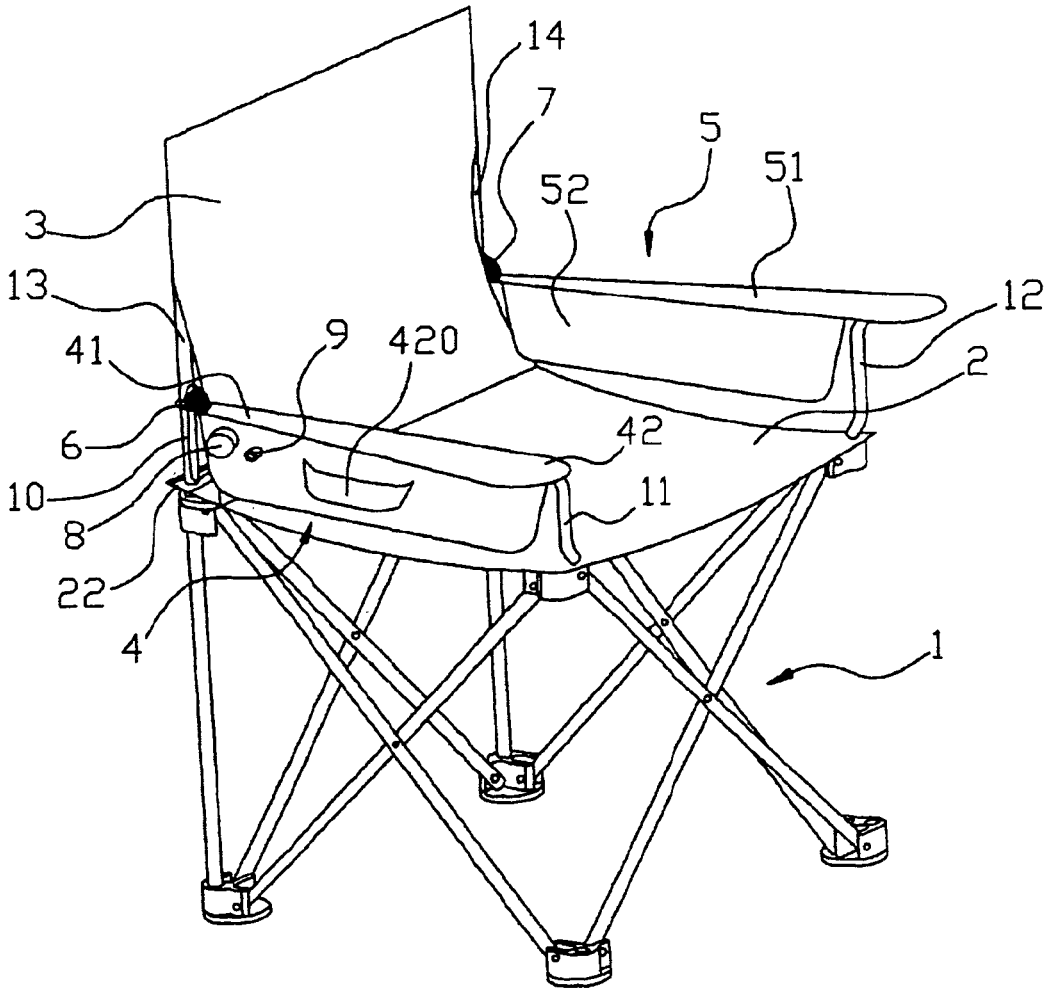
FIG. 2 is the perspective view of the present invention in 3-dimensional drawing. Example two.
Figure 3:
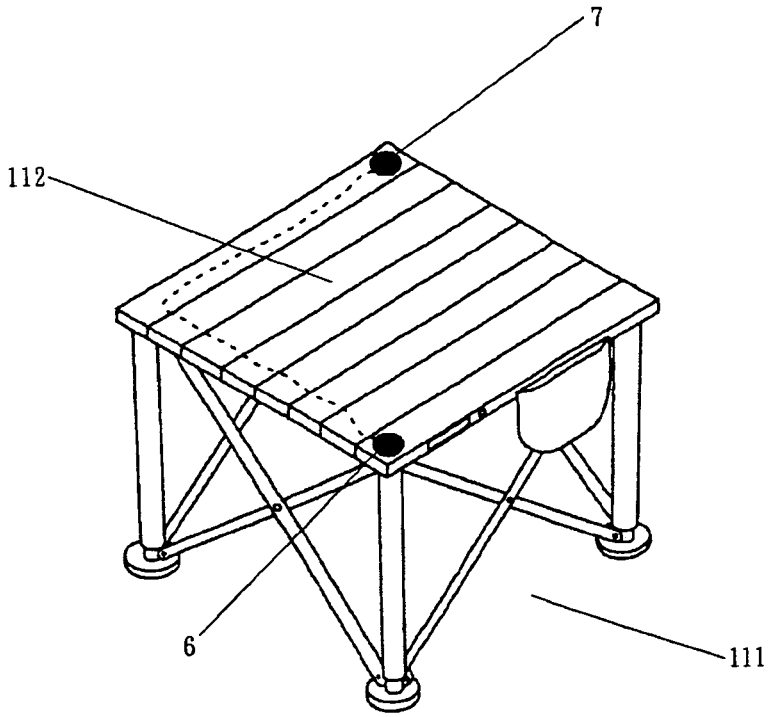
FIG. 3 is the perspective view of the idea of the invention when applied on another object. Example one.
Figure 4:
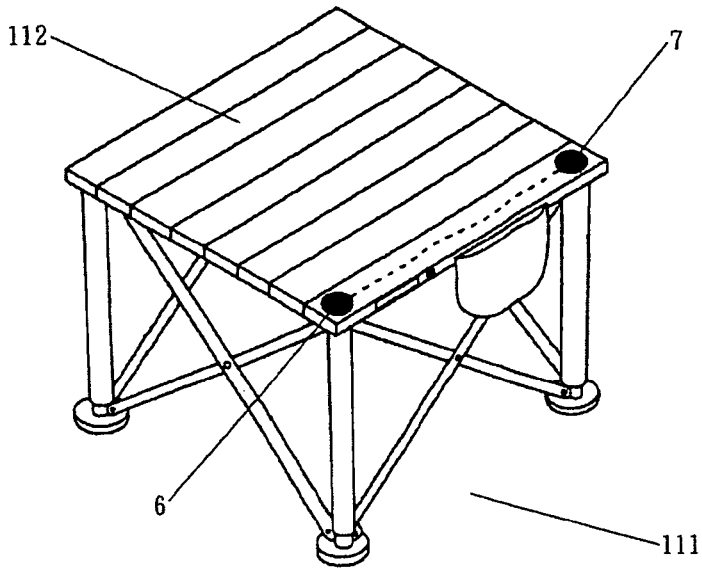
FIG. 4 is the perspective view of the idea of the invention when applied on another object. Example two.
Figure 5:
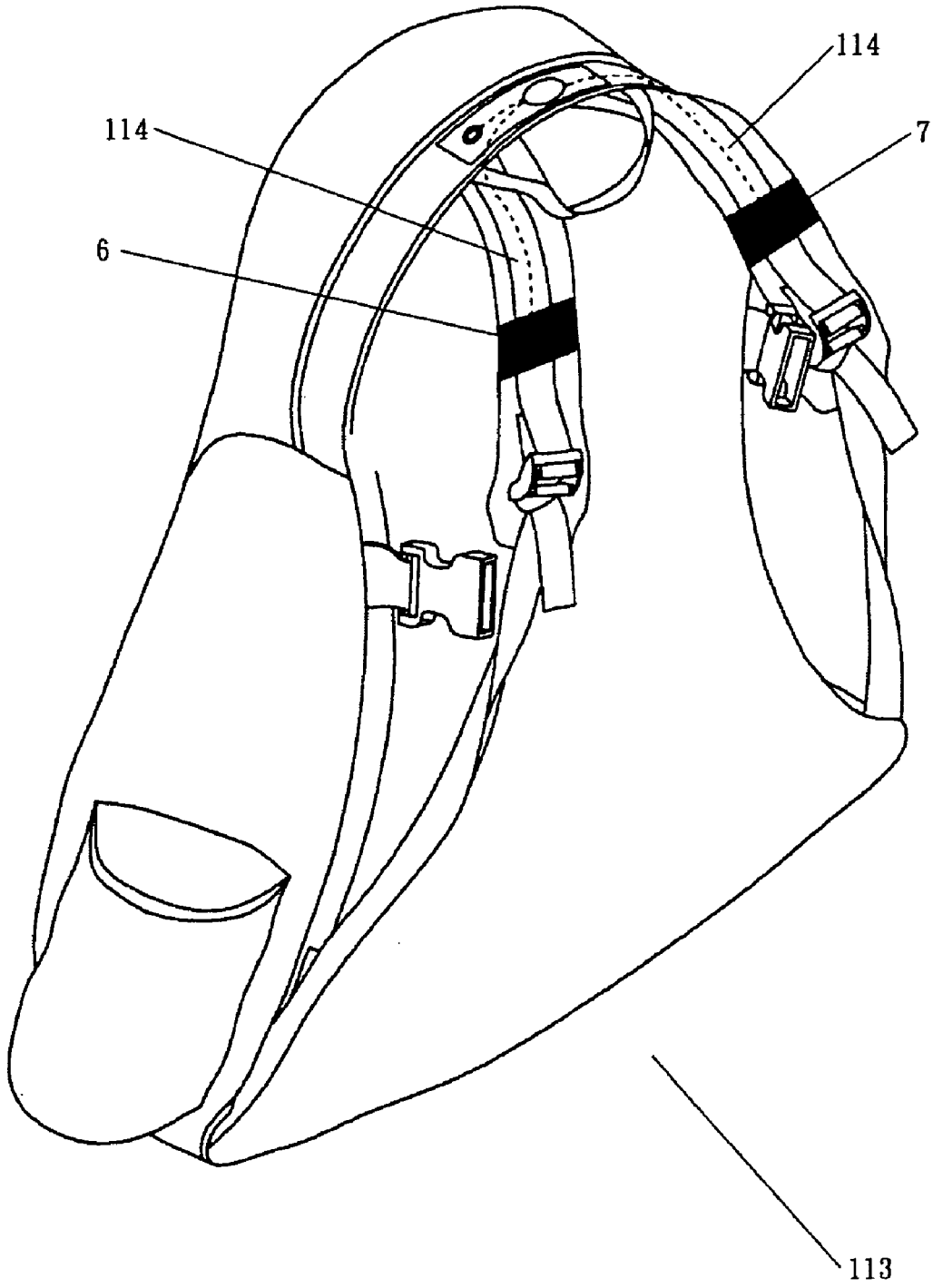
FIG. 5 is the perspective view of the idea if the invention when applied on a backpack.

Referring to FIG. 1 and FIG. 2. A folding chair that comes with a portable stereo system. The present invention includes foldable supporting frame (1), chair seat (2), chair back (3), primary armrest (4), secondary armrest (5), mini boom box (6&7), battery channel (8), audio frequency receiver (9), audio frequency wire (10), primary armrest support (11), secondary armrest support (12), chair back support panel (13&14), chair front edge (21), horizontal face (41&51), vertical face (42&52), and a music-player sack (420).

The mini boom boxes are in stored on the armrest of both sides, but they can also be in stored on other parts of the chair in which are most convenient.

The main aspect of the present invention is to offer people traveling with a convenience of both seating and music-listening purposes. Therefore, the present invention employs an idea that differs than those conventional folding chairs on the market. With this idea that the present invention employs, it can increase the peripheral values onto folding chairs and therefore increases market competition.

The two mini boom boxes are connected to the audio frequency receiver by the battery channel, of which has batteries be stored. The audio frequency wire is set to go along with the chair front edge. Thus, the audio frequency wire will not trouble the person who sits on the chair since it doesn't cross any other parts of the chair.

On each side of the armrest, there is one horizontal face (41&51) and one vertical face (42&52). The purpose of the horizontal face (41&51) is to fix the front portion of the foldable supporting frame (1), the primary armrest (4) and the secondary armrest (5). Also, there is one music-player sack on the horizontal face of the folding chair. It is designed to offer people the convenience to place a music-playing device such as a CD player or a MP3 player so when they listen to music they can be hands-free.

The battery channel (8) is set on the vertical face (42) of which is near the mini boom box (6). The battery channel is connected to the audio frequency receiver (9), and has batteries be stored in order to transmit frequencies to both mini boom boxes (6&7).

The invention claimed is:

1. A folding chair with portable stereo system, comprises a seat, a back, two armrests, the foldable supporting frame, two mini boom boxes, a battery channel, an audio frequency receiver, audio frequency wire, a chair front edge, horizontal surfaces of the armrests, vertical surfaces of the armrests, and a music player sack; wherein a battery channel connected to the audio frequency receiver in order to transmit frequencies to both mini boom boxes is set on the vertical surface of the armrests which is near the mini boom box; and wherein audio frequency wire is secured to and extends along the front edge of the chair.

2. A folding chair with portable stereo system as defined in claim 1, wherein the audio frequency wire will not trouble the person who sits on the chair since it does not cross any parts of the chair.

* * * * *